United States Patent [19]

Rose

[11] Patent Number: 4,998,897

[45] Date of Patent: Mar. 12, 1991

[54] ELECTRICAL CONNECTOR END CAP

[75] Inventor: Howard W. Rose, Boiling Springs, Pa.

[73] Assignee: AMP Incorporated, Harrisburg, Pa.

[21] Appl. No.: 558,022

[22] Filed: Jul. 26, 1990

[51] Int. Cl.[5] ..... H01R 13/00

[52] U.S. Cl. ..... 439/629

[58] Field of Search ..... 439/629–637

[56] References Cited

U.S. PATENT DOCUMENTS

| | | | |
|---|---|---|---|
| 3,516,046 | 6/1970 | Gettig | 439/633 |
| 3,533,045 | 5/1970 | Henschen | 339/17 |
| 3,573,711 | 11/1971 | Henschen | 339/61 |
| 3,601,770 | 8/1971 | Bowley | 439/629 |
| 4,586,254 | 5/1986 | Ammon et al. | 439/636 |

*Primary Examiner*—Joseph H. McGlynn

*Attorney, Agent, or Firm*—Katherine A. Nelson

[57] ABSTRACT

An electrical connector assembly (10) includes a dielectric housing (12) open on each end and having a longitudinal cavity (26) and vertical apertures (20) defined by dielectric housing material with end caps (30) configured to fit in the longitudinal cavity with latches (38, 40) adapted to fit within the vertical apertures and latch the caps (30) to the housing (12). Terminals (23) having contact elements (25) are disposed within housing (12) such that spring contact elements (25) are positioned to terminate to conductive traces (46) on circuit board (44).

5 Claims, 3 Drawing Sheets

ELECTRICAL CONNECTOR END CAP

FIELD OF THE INVENTION

This invention relates to electrical connectors of a type having open ends with end caps fitted thereon and locked thereto.

BACKGROUND OF THE INVENTION

For reasons of economy of production with respect to certain types of electrical connectors, a practice has evolved of fabricating the plastic connector housings into the largest size which can be practically molded, thermoformed, or otherwise made with such product separated as by cutting or shearing into a variety of different smaller sizes. Thus, in U.S. Pat. No. 3,573,711 granted Apr. 6, 1971, a circuit board connector is shown having a housing of dielectric material which can be molded in strips having as many as fifty terminal positions and then subsequently sliced into shorter lengths to form connectors of, for example, five ten-position connectors or ten five-position connectors. U.S. Pat. No. 3,533,045 issued Oct. 6, 1970 shows a similar circuit board connector having a housing open at the ends and utilizing plugable supports at the end of the housings to accommodate a circuit board fitted into the connector. The connectors of these prior art patents require separate pieces to be plugged into the circuit board or into the connectors for guide functions and in some instances, leave the ends of the connectors open.

It is an object of the present invention to provide an improved electrical connector having end caps that are locked thereto, thereby facilitating the shipment, handling, and assembly of connectors into circuit boards as one integral piece.

The invention has as a further object the provision of a closed end connector which is fabricated from long strips of connector housings with end caps that fit into and latch to the open ends of such strips in various lengths to provide a closed end connector.

It is still a further object to provide an improved electrical connector of a type accommodating circuit boards inserted therein.

SUMMARY OF THE INVENTION

The present invention features an electrical connector of a type which is made to receive and support a daughter card in a form of a circuit board and facilitate interconnection of the daughter card to a mother board type of circuit board. The housing of the connector of the invention is made of a configuration to be molded in lengthy strips or sticks and then sliced at a precise location at the ends thereof into smaller connectors with molded end caps having features which allow the closure of such connectors. The end caps have projections that fit within longitudinal cavities of the connector housings and contain latches which fit within vertical cavities of the housing so that the end caps may be slid in the end, relatively horizontally, and then forced downwardly or vertically such that the latches are deformed and then snap outwardly to latch the end caps to the housings. The end caps have walls which completely enclose the ends of the housings and the projections of such caps are grooved to receive the ends of circuit boards inserted into such connectors.

IN THE DRAWING

Figure 7:
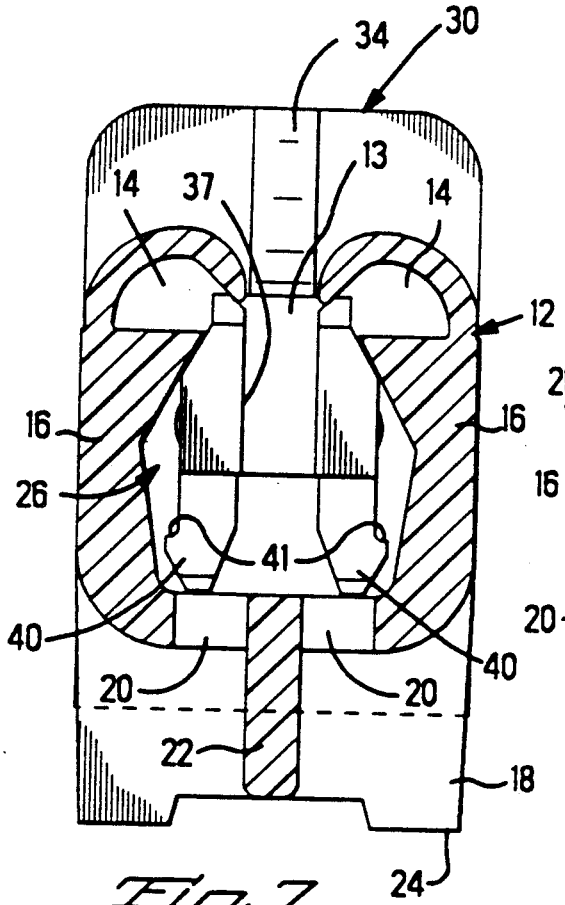
Figure 8:
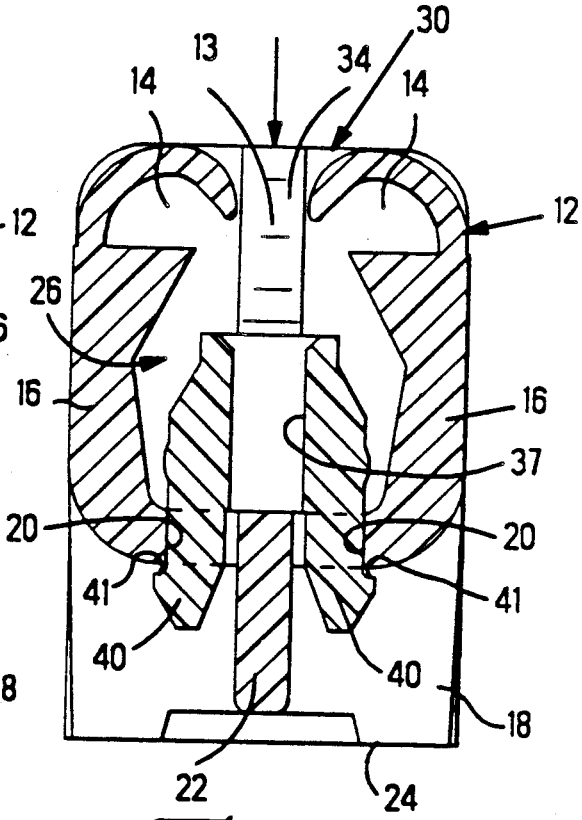
Figure 5:
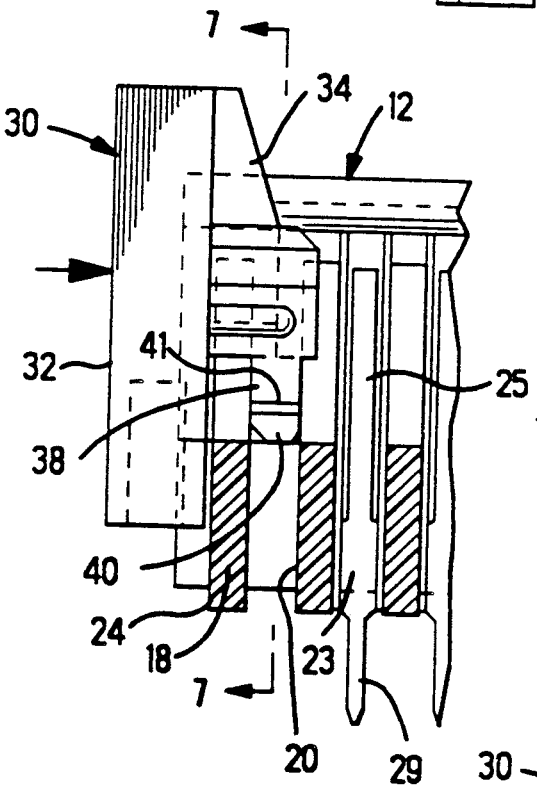
Figure 6:
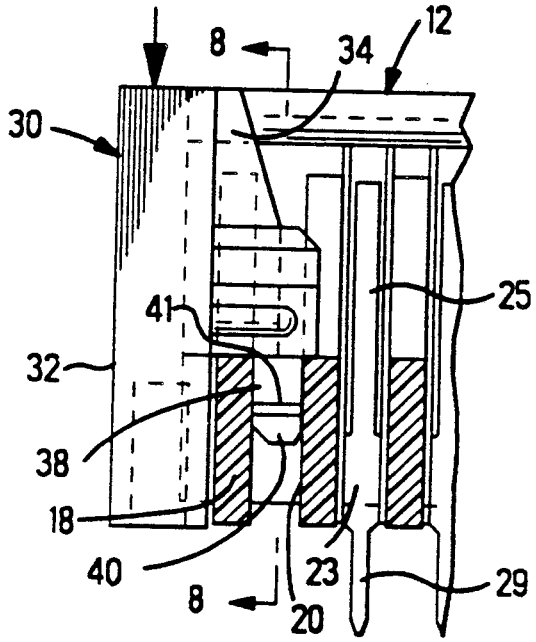

FIGS. 7 and 8 are sectional views taken through lines 7—7 and 8—8 in FIGS. 5 and 6 respectfully.

DETAILED DESCRIPTION OF THE INVENTION

Figure 1:
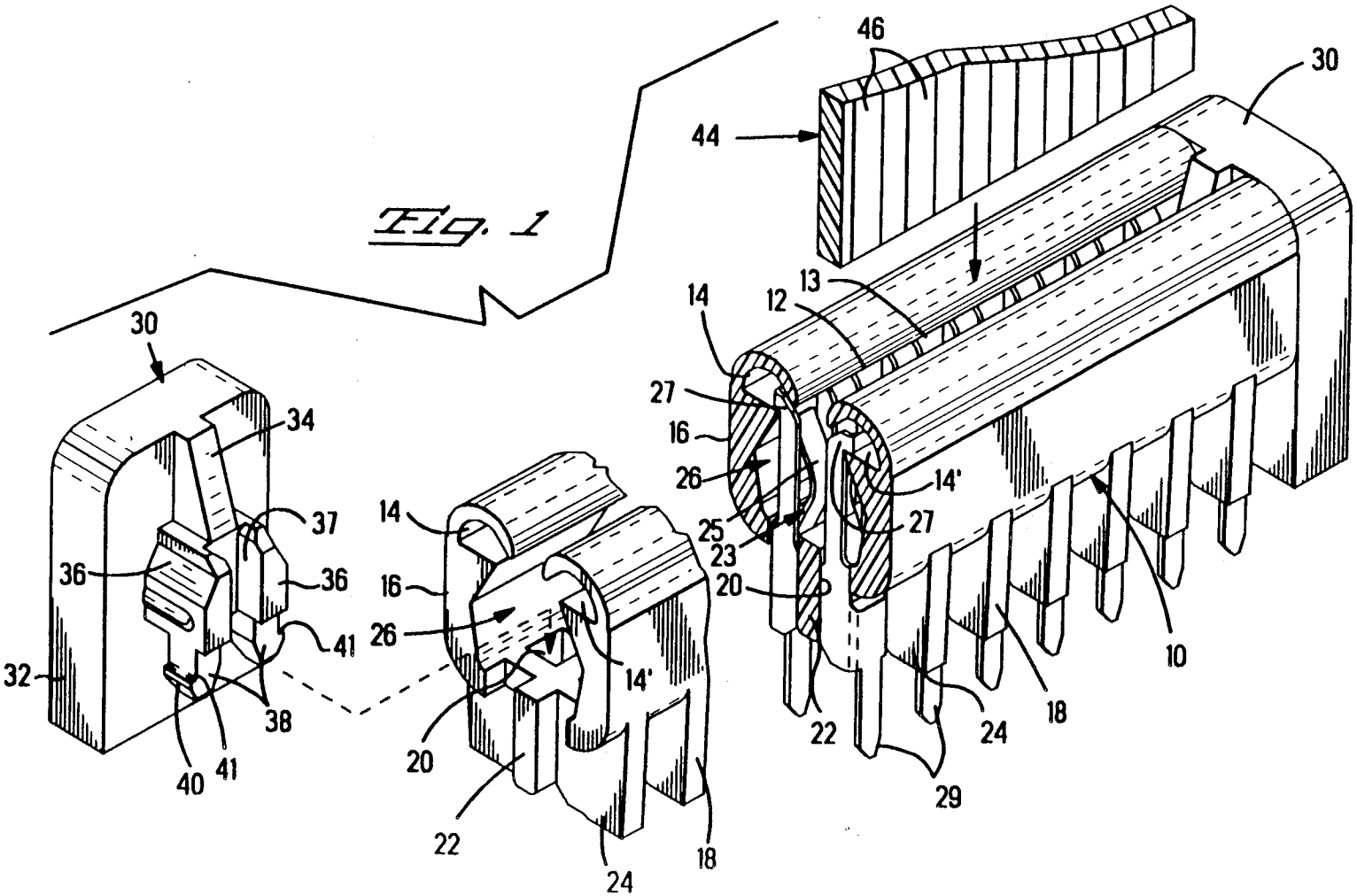
FIG. 1 is an exploded perspective view showing the connector of the invention with an end cap removed therefrom.

Referring now to FIG. 1, an electrical connector 10 is shown preparatory to receiving a circuit board 44 having conductive traces 46 thereon. The conductive traces 46 will be engaged by terminals 23 within the connector 10. The terminals 23 in turn interconnect traces 46 to conductive circuits in a mother board or back plane (not shown). The connector 10 includes a housing 12 typically molded of engineering plastic of the nylon family, the plastic having excellent dielectric qualities. The housing 12 includes the details shown in FIG. 1 including at the top edge portion thereof a slot 13 that extends along the length of the connector facilitating insertion of board 40 within the connector 10. Just adjacent the top are a pair of longitudinal cavities 14, 14' which define the interior surfaces receiving and facilitating the support and latching of terminals 23 in the manner shown in FIG. 1. The housing includes vertical side walls 16 which join downward projecting portions 18, through which are provided apertures 20 defined by the walls of 18 and an interior wall shown as 22. The wall 22 shown in FIG. 1 has been severed but it is to be understood to extend through the center lower region of the connector housing 12. The projections 18 end in further projections 24 as best seen in FIGS. 5 and 7, which serve as standoffs to hold the connector housing 12 sufficiently clear of the mother board to allow a washing away of salts, flux, and other products of the soldering process following soldering of the connector 10 to the mother board. The walls 16 are spaced apart to define a relatively large interior cavity 26 extending longitudinally through the housing 12. This cavity 26 facilitates the insertion of the circuit board 44 well within the housing 12 and the disposition therein of the respective spring contact element 25 of the electrical terminals 23, a single element 25 being shown in the housing 12 of FIG. 1.

With respect to the invention, the housings 12 are preferably molded in strips or sticks in lengths as long as is practicable given the particular plastic material, the molding technique, and the various sizes required for housings in terms of number of cavities. The principal limitation other than number of cavities has to do with the practical limit on core pins which are in the mold to define the longitudinal cavities 14 and 26. With the housing molded in the largest size possible, the housings may be sliced into appropriate subsizes by shearing through the body of the housing 12 in the manner shown in FIG. 1. This shearing takes place essentially through the middle of the housing 12 as defined by the different wall portions of the projections 18. This leaves a small portion of projection 22 and the end walls 16 projecting outwardly of the body of the housing 12.

The terminals 23 are fitted into respective apertures 20 and slot 26 in the housing 12 in an orientation to direct respective spring contact elements 25 of each terminal 23 into slot 26 and into position to engage corresponding conductive traces 46 on circuit board 44, on either side thereof. Thus there would be a spring contact element 25 opposite to the one shown in FIG. 1 and in essence two rows of contact elements carried by the housing 12. The upper end 27 of terminal 23 fits within the cavity 14 to hold the terminal 23 in position. The lower end of each terminal 23 protrudes through its respective aperture 20 and beneath the housing 12 to define a solder tab or post 29 which fits through an aperture in a mother board (not shown) and is soldered to the conductive traces therein or thereon In this way, components carried by a daughter board such as 40 are interconnected to other components carried by other daughter boards and to other circuits through the mother board connection.

Figure 2:
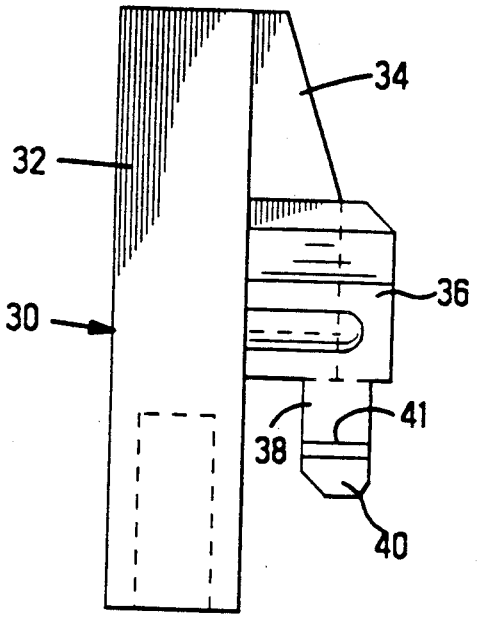
FIG. 2 is a side elevational view of the end cap of the invention.
Figure 3:
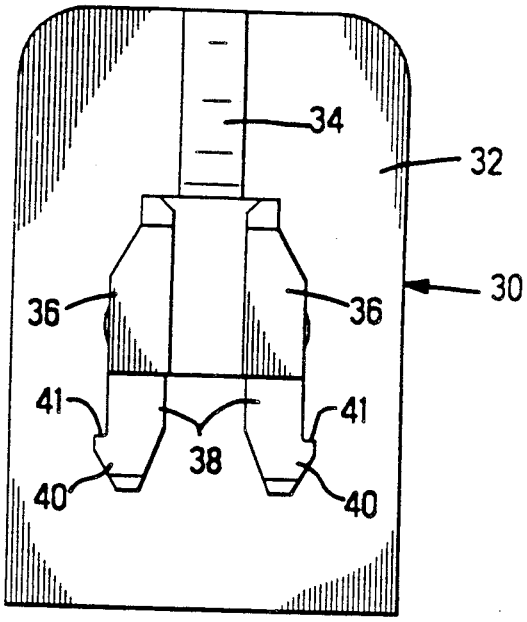
FIG. 3 is a further elevational view showing the cap of the FIG. 2 rotated 90 degrees.

The housings 12, being open-ended following severing, are provided with end caps 30, one end cap 30 being shown in place in FIG. 1 to completely cover the opening of one end of housing 12. FIG. 1 shows to the left an end cap 30 preparatory to its being positioned within housing 12 and latched thereto. As shown in FIGS. 1, 2 and 3 end cap 30 includes an end wall 32 which is of a height to extend from the top of housing 12 to the bottom thereof in line with the end of projection 24. At the center of the cap is a wall 34 which slopes downwardly, the downward slope or beveling serving to engage the edge of the circuit board 44 when inserted within the housing and guide board 44 into position. On either side of the projection 34 is a further projection integrally formed of the material of the end cap, including projections 36 which are spaced apart to define a slot 37 which operates to receive the side edge of circuit board 44 and position it in alignment for proper engagement of circuit traces with contact springs 25.

Figure 4:
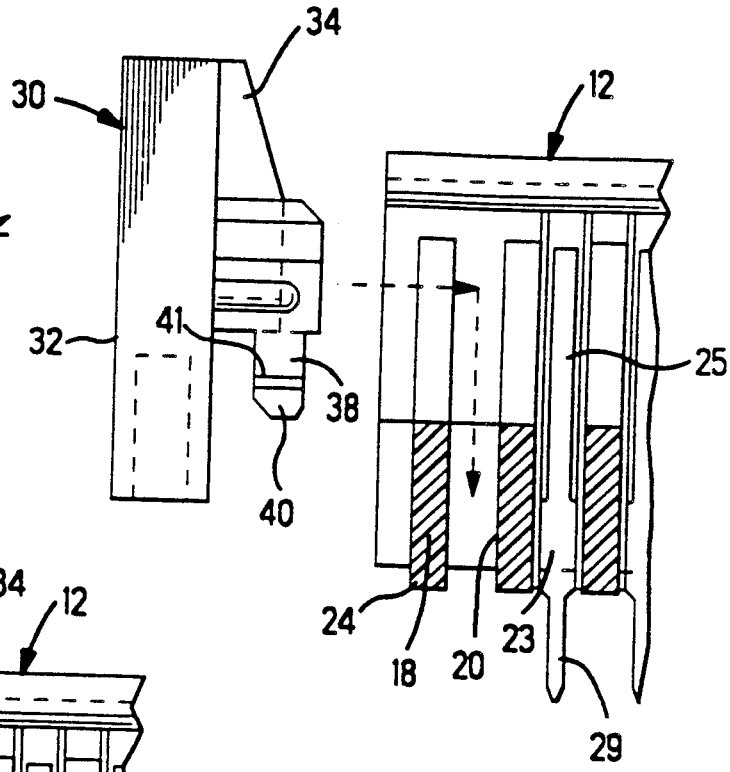
FIGS. 4, 5 and 6 are elevational partially sectional views of the end of the connector of the present invention illustrating the unassembled, partially assembled, and fully assembly conditions respectfully.

Each of the projections 36 includes a further downward projecting leg 38 terminated in a latch 40 having an upper surface 41 projecting outwardly in the manner shown in FIG. 3. The latches 40 are beveled to facilitate insertion within corresponding end apertures 20. The outline of the projections including 34, 36, 38, and the latches 40 is such to facilitate entry into the cavity 26, the longitudinal cavity of housing 12, in an easy sliding fit Thus, in assembly, the end cap 30 would be positioned proximate the end of housing 12 as shown in FIG. 4 and then slid horizontally with the projections 36 thereof extending into the longitudinally cavity 26 as shown in FIGS. 5 and 7. Thereafter, the end cap 30 is pressed downwardly with the beveled portions of 40 camming against the outside edges of the cavities of 20, and the lower inside edges of walls 16 as shown in FIG. 6 and 8. The projections 38 allow the inward deflection of the latches 40 until the surfaces 41 engage the bottom surfaces of walls 16 and the latches 40 spring outwardly to latch the end caps in position seated in the manner as shown by right end cap 30 in FIG. 1 and in end view in FIG. 8. With the end caps 30 so fitted, they are in essence locked to the housing 12 and the housing, including its end caps and contacts contained therewithin, becomes a one-piece assembly which can be shipped, handled, inventoried, and eventually assembled into a mother board.

Having now described the invention in terms intended to enable a preferred practice thereof, I set forth what is deemed inventive in the appended claims.

I claim:

1. An electrical connector including:

a dielectric housing having a longitudinal cavity extending therethrough from end to end, a slot in the top of said housing extending into said longitudinal cavity to receive a circuit board inserted therein, the ends of said cavity being open, a plurality of vertical apertures extending along the bottom of said housing opening into said longitudinal cavity to receive and retain terminal members oriented to engage said circuit board, and further extending through the bottom of said housing to accommodate portions of said terminal members extending through said housing to be fitted within corresponding apertures and of a further circuit board and soldered thereto;

end caps including end walls configured to cover end profiles of said housing and said open ends of said longitudinal cavity said end caps including projections extending transversely to said end wall and of a configuration to fit in easy sliding engagement within said longitudinal cavity of said housing, said caps further including latch means extending from said projections, said latch means adapted to engage the vertical walls of corresponding ones of said vertical apertures and be biased inwardly to facilitate the downward displacement of said end caps with a said latch means engaging lower wall surfaces of said housing to lock said end caps to said housing as said caps are inserted horizontally and pushed downwardly therewithin.

2. The connector of claim 1 wherein said latch means comprises a pair of dielectric spring elements beveled at the ends and dimensioned to be driven inwardly yieldingly upon insertion into the said vertical cavities and snap outwardly to latch against interior surfaces of the bottom of said housing

3. The connector of claim 1 wherein the said projections of each end cap includes a slot adapted to engage the edge of a circuit board inserted in said housing and center said circuit board with respect to terminals in said housing.

4. The connector of claim 1 wherein each of said projections of said end caps includes a beveled surface leading to a slot defined by said projections to guide said circuit board and hold the edges thereof centered in the housing of said connector.

5. An electrical connector comprising:

a dielectric housing having a longitudinal slot in the upper surface thereof to receive a circuit board inserted therein, a longitudinal cavity extending through said housing from end to end adapted to facilitate the insertion of said circuit board;

electrical terminals fitted in said housing adapted to electrically engage said circuit board, said housing further including a series of vertical cavities adapted to receive portions of said terminals extending through said housing to fit in a further circuit board and be joined thereto, said vertical cavities having horizontal edge surfaces;

and a pair of end caps adapted to fit on the ends of said housing to cover the ends, each of the said end caps having a beveled surface leading to a slot therein operable to guide the edge ends of said circuit board and center said circuit board relative to said housing and said terminals, each of said end caps including a pair of latches extending vertically and having a profile to fit within longitudinal cavity upon horizontal inward displacement thereof and further operable to fit within vertical cavities proximate the ends of said housing and be deformed by the walls thereof inwardly upon downward displacement of said end caps relative to said housing, said latches including surfaces to engage horizontal surfaces at the bottom of said apertures to snap outwardly and latch said end caps to said housing.

* * * * *